US011149924B2

(12) United States Patent
Marcucci et al.

(10) Patent No.: US 11,149,924 B2
(45) Date of Patent: Oct. 19, 2021

(54) SYSTEM, APPARATUS, AND METHODS FOR ADJUSTABLE FOCAL LENGTH LIGHT

(71) Applicant: Alliance Sports Group, L.P., Fort Worth, TX (US)

(72) Inventors: Todd Marcucci, Mansfield, TX (US); Gregory Lee Horne, Euless, TX (US)

(73) Assignee: Alliance Sports Group, L.P., Fort Worth, TX (US)

( * ) Notice: Subject to any disclaimer, the term of this patent is extended or adjusted under 35 U.S.C. 154(b) by 51 days.

(21) Appl. No.: 16/569,958

(22) Filed: Sep. 13, 2019

(65) Prior Publication Data

US 2021/0080080 A1 Mar. 18, 2021

(51) Int. Cl.

| | |
|---|---|
| ***F21V 14/06*** | (2006.01) |
| ***F21V 5/04*** | (2006.01) |
| ***F21V 23/00*** | (2015.01) |
| *F21Y 115/10* | (2016.01) |

(52) U.S. Cl.

CPC ..... *F21V 14/065* (2013.01); *F21V 5/04* (2013.01); *F21V 23/009* (2013.01); *F21Y 2115/10* (2016.08)

(58) Field of Classification Search

CPC .... F21V 5/006; F21V 23/0414; F21V 14/065; F21V 5/04; F21V 23/009; F21L 4/027

See application file for complete search history.

(56) References Cited

U.S. PATENT DOCUMENTS

| | | | | |
|---|---|---|---|---|
| 6,357,893 | B1 * | 3/2002 | Belliveau ..... | F21L 4/027 362/285 |
| D532,138 | S | 11/2006 | Wang et al. | |
| D644,775 | S | 9/2011 | Nguyen et al. | |
| 8,104,915 | B1 * | 1/2012 | Osterhout ..... | H01M 10/443 362/202 |
| D659,271 | S | 5/2012 | Nguyen et al. | |
| D739,060 | S | 9/2015 | Chouprinov et al. | |
| D745,209 | S | 12/2015 | Picciotta et al. | |
| D786,466 | S | 5/2017 | Prieto | |
| D846,783 | S | 4/2019 | Eichelberger | |
| D858,834 | S | 9/2019 | Huang | |
| 10,711,953 | B1 | 7/2020 | Zhu et al. | |
| D896,421 | S | 9/2020 | Saboo | |
| D897,578 | S | 9/2020 | Le | |

(Continued)

FOREIGN PATENT DOCUMENTS

| | | |
|---|---|---|
| CN | 304928691 | 12/2018 |
| CN | 305190481 | 5/2019 |
| CN | 305212428 | 6/2019 |

OTHER PUBLICATIONS

"SureFire G2X Pro 600 Lumen Tactical EDC Flashlight." Feb. 23, 2015, amazon.com, site visited Jun. 3, 2021, URL: https://www.amazon.com/SUreFire-Tactical-Flashlight-Batteries-Lightjunction/dp/B07BH2HYXG/ (year 2015). 8 Pages.

(Continued)

*Primary Examiner* — Joseph L Williams

(74) *Attorney, Agent, or Firm* — Thorpe North & Western, LLP

(57) ABSTRACT

A lighting device is disclosed having a plurality of light emitting diodes of varying light intensities disposed about the same substrate. A lens is configured with a geometry that corresponds to different sections of the substrate containing the light emitting diodes of different light intensities.

21 Claims, 8 Drawing Sheets

(56) References Cited

U.S. PATENT DOCUMENTS

| | | | | |
|---|---|---|---|---|
| D897,579 | S | 9/2020 | Le | |
| D899,646 | S | 10/2020 | Shan | |
| D899,647 | S | 10/2020 | Shan | |
| D899,649 | S | 10/2020 | Qiu | |
| D905,885 | S | 12/2020 | Kotsis et al. | |
| D914,258 | S | 3/2021 | Qiu | |
| D914,938 | S | 3/2021 | Qiu | |
| 2006/0203477 | A1 | 9/2006 | Chien | |
| 2014/0268713 | A1 | 9/2014 | Unger et al. | |
| 2016/0033107 | A1* | 2/2016 | Windom | F21V 5/006 362/184 |
| 2016/0341373 | A1 | 11/2016 | Mertel et al. | |
| 2019/0293245 | A1 | 9/2019 | Horne et al. | |
| 2020/0208793 | A1 | 7/2020 | Horne et al. | |
| 2021/0080080 | A1 | 3/2021 | Marcucci et al. | |

OTHER PUBLICATIONS

"SureFire Everyday Carry LED." Jan. 17, 2019, amazon.com, site visited Jun. 3, 2021, URL: <amazon.com> (year 2018). 11 Pages.
"NEBO Unboxed: Redline BLAST RC." Oct. 16, 2018, youtube.com, site visited Jun. 5, 2021, URL: <https://www.youtube.com/watch?v=dd_tl=-_KMfk> (Year 2018). 1 Page.
"NEBO Redline Big Daddy 2000 Lumen Flashlight." Mar. 1, 2018, amazon.com, site visited Jun. 5, 2021, URL: https://www.amazon.com/NEBO-Fashlisht-Batieres-Lumintrail-keychain/dp/B07B5JPBBN/ (year 2008) 8 Pages.

* cited by examiner

SYSTEM, APPARATUS, AND METHODS FOR ADJUSTABLE FOCAL LENGTH LIGHT

FIELD OF THE TECHNOLOGY

The current application relates to lighting devices. More particularly, the current application is directed to an improved apparatus for optimizing light output from a lighting device.

BACKGROUND

Light emitting diodes (LEDs), and their inherent benefits, have become increasingly popular. LED devices use high power LEDs in order to use as few LEDs as possible to achieve a desired lumen output. Generally speaking, the higher the power pushed through the LED, the greater lumen output. But high power LEDs are reaching a technological limit on the amount of lumens that can be generated. In addition, high-output LEDs may each draw currents greater than is practical for packaged LED modules and dissipate more power than can be radiated or conducted away from the module efficiently. Since LED dies are packaged very small to minimize required board space, adequate heat removal is difficult. A common design is to mount high power LEDs on a flat, heat conductive substrate and provide a diffusive envelope around the substrate. Removing heat from such designs, using ambient air currents, is difficult since the LED may be mounted in any orientation. Metal fins or heavy metal heat sinks are common ways to remove heat from such systems, but such heat sinks add significant cost and have other drawbacks. It is desirable to have other methods of increasing the light output of a lighting device or the appearance of output from a lighting device.

BRIEF DESCRIPTION OF THE DRAWINGS

The present technology will become more fully apparent from the following description and appended claims, taken in conjunction with the accompanying drawings. Understanding that these drawings merely depict examples of the present technology they are, therefore, not to be considered limiting of its scope. It will be readily appreciated that the components of the present technology, as generally described and illustrated in the figures herein, could be arranged and designed in a wide variety of different configurations. Nonetheless, the invention will be described and explained with additional specificity and detail through the use of the accompanying drawings in which:

DESCRIPTION OF EMBODIMENTS

Figure 1:
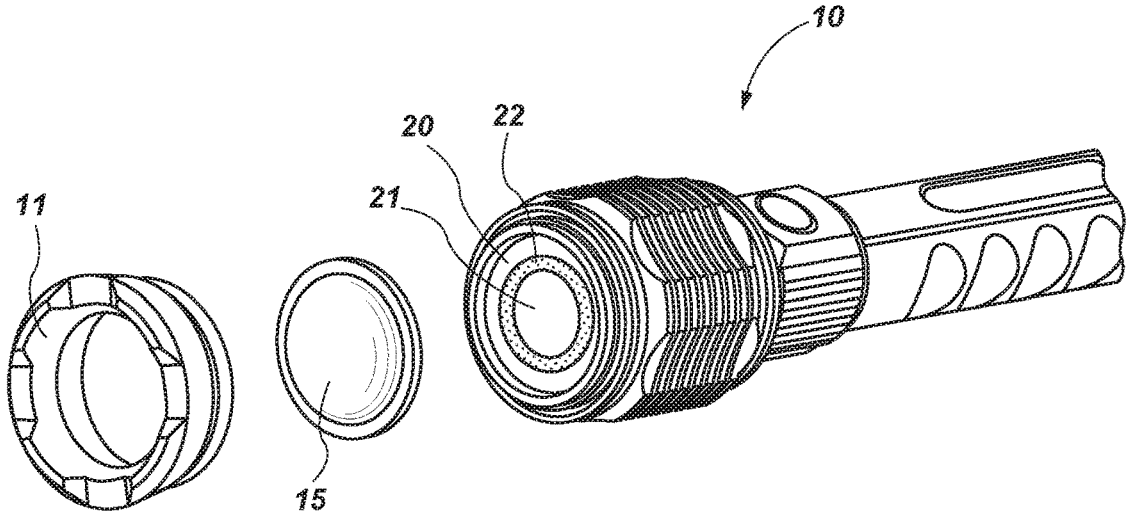
FIG. 1 is a partial exploded view of a hand held light in accordance with one aspect of the technology.

Although the following detailed description contains many specifics for the purpose of illustration, a person of ordinary skill in the art will appreciate that many variations and alterations to the following details can be made and are considered to be included herein. Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein. The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. Unless otherwise stated, use of the term "about" in accordance with a specific number or numerical range should also be understood to provide support for such numerical terms or range without the term "about". For example, for the sake of convenience and brevity, a numerical range of "about 50 angstroms to about 80 angstroms" should also be understood to provide support for the range of "50 angstroms to 80 angstroms."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

Reference in this specification may be made to devices, structures, systems, or methods that provide "improved" performance. It is to be understood that unless otherwise stated, such "improvement" is a measure of a benefit obtained based on a comparison to devices, structures, systems or methods in the prior art. Furthermore, it is to be understood that the degree of improved performance may vary between disclosed embodiments and that no equality or consistency in the amount, degree, or realization of improved performance is to be assumed as universally applicable.

EXAMPLE EMBODIMENTS

An initial overview of technology embodiments is provided below and specific technology embodiments are then described in further detail. This initial summary is intended to aid readers in understanding the technology more quickly, but is not intended to identify key or essential features of the technology, nor is it intended to limit the scope of the claimed subject matter.

Figure 2:
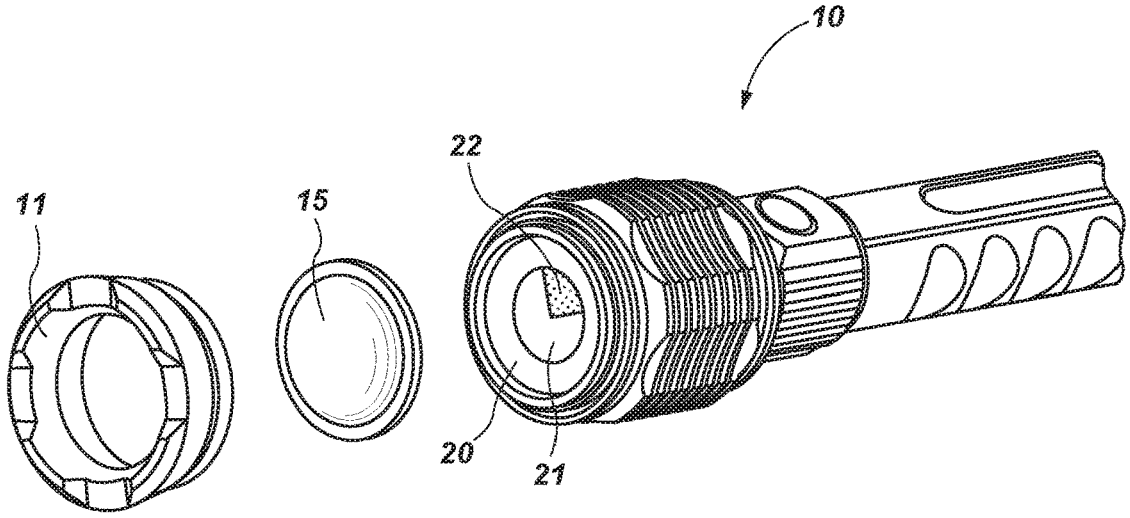
FIG. 2 is a partial exploded view of a hand held light in accordance with one aspect of the technology.
Figure 3:
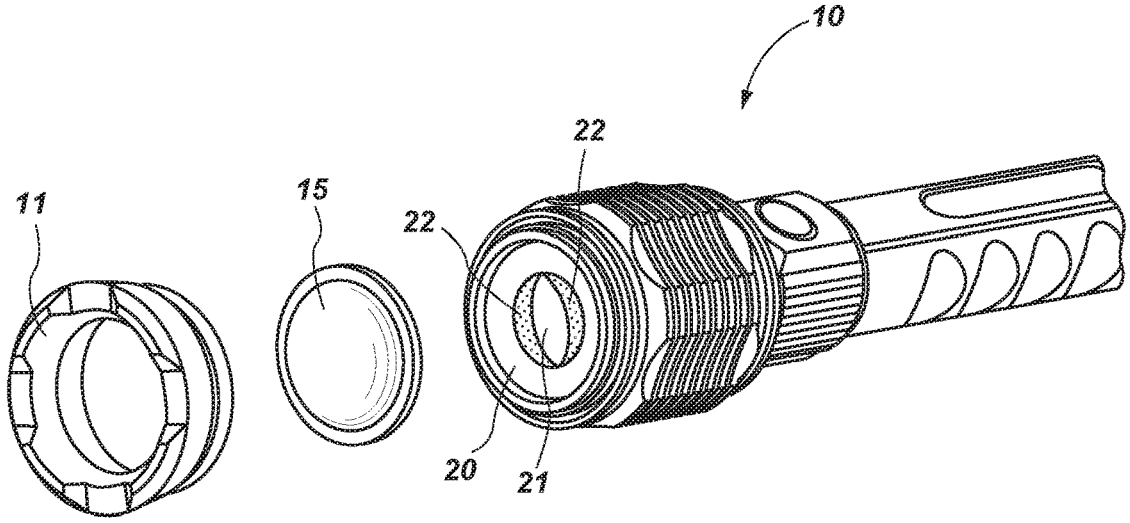
FIG. 3 is a partial exploded view of a hand held light in accordance with one aspect of the technology.
Figure 4:
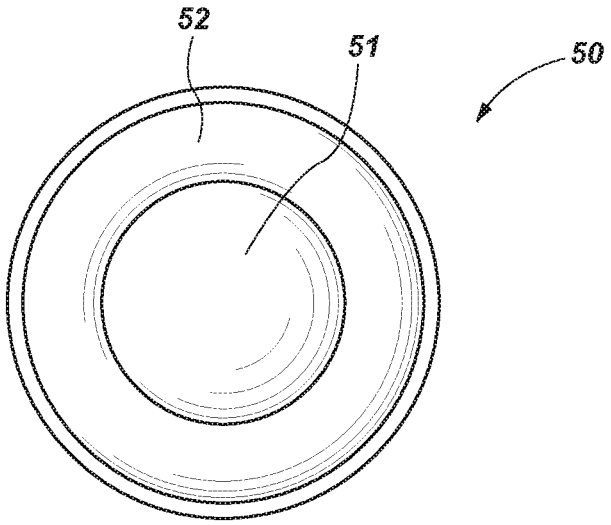
FIG. 4 is a top view of a lens in accordance with one aspect of the technology.
Figure 5:
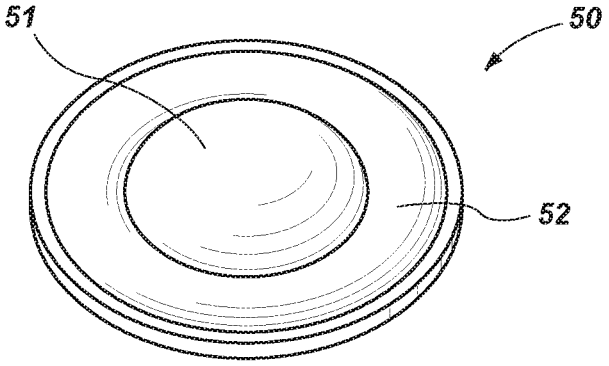
FIG. 5 is a perspective side view of a lens in accordance with one aspect of the technology.
Figure 6:
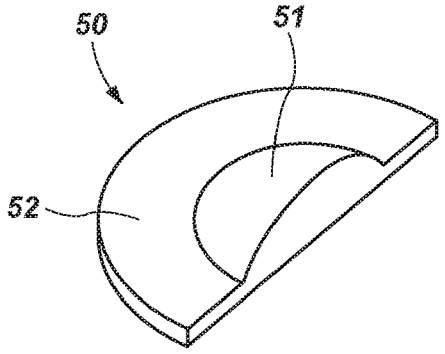
FIG. 6 is a perspective cross-sectional view of a lens in accordance with one aspect of the technology.
Figure 7:
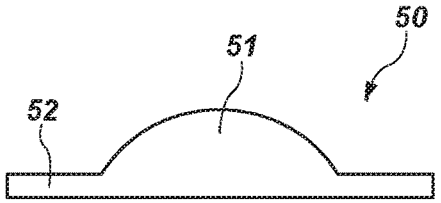
FIG. 7 is a cross-sectional side view of the lens of FIG. 6.

Broadly speaking, with general reference to FIGS. 1-3, aspects of the current technology operate to provide the appearance of increased lumen output of an LED light system, or alternatively, the appearance of light output commensurate with a high power LED light system by mixing LED chips or dies of different light intensities on a single substrate (or multiple substrates) coupled with a secondary system for optimizing the projection of light so that it appears to the user to be propagating light from a system of high intensity LEDs. Aspects of the current technology, also include an increased lumen output of an LED lights system comprising a plurality of LEDs of similar light intensities or power ratings on a single substrate. Other aspects of the technology include a single LED, or a plurality of LEDs mounted on a substrate to form an LED subassembly. A plurality of those LED subassemblies can be mounted on another substrate, wherein each subassembly can be selectively powered on and off, or selectively provided with greater or lesser power. Each LED subassembly can have different LEDs with similar power ratings, or different power ratings as suits a particular purpose.

Thermal management can be a challenge especially with high power density LEDs. The luminous output of an LED or LED "Chip on Board" or "COB" is related to its temperature. A high temperature lowers the optical output power of an LED. The junction temperature in a LED is a function of the electrical power driven into the LED, the ratio of power turned into heat, and thermal resistance to heat dissipation. COBs are common when space is not constrained, so heat dissipation is traditionally less of a concern. COBs are also used in lighting devices with a fixed lens to cast a broad beam of light over an area. They have not been used in connection with a focusing or axially adjustable lens because the distributed source of light that accompanies a COB is not fully capture in an adjustable lens system, resulting in inefficiencies.

The primary factors affecting the thermal resistance of LEDs are its internal thermal resistance, the thermal resistance of electrical interconnections, the thermal resistance of any heat dissipating (heat sink) structures, and the heat convection capability of the LED's encapsulation. The sum of all thermal resistances in a component together with the thermal power or heat generated, defines how much the temperature rises in the component over the ambient temperature.

LEDs are assembled on a metal core printed circuit board (MCPCB), or on aluminum substrate, which is connected to a ceramic, plastic or aluminum heat sink. Ceramic heat sinks make it possible to use different thick film methods to manufacture the interconnections directly on top of the heat sink. Plastic heat sinks are used mainly with MCPCBs for relatively low power solutions. After the heat has been conducted through the thermal interfaces between the heat dissipating body and the PCB or MCPCB into its aluminum plate, further heat conduction is done from the bottom of the PCB, enhanced by different thermal interface materials and different fastening methods, e.g. screws. In many LED lighting applications, several high power LEDs need to be placed in close configuration. Such applications include, but are not limited to, spot lights, COB LED module structures, etc. The heat generating components, their power supplies, the PCBs, the thermal interface materials and solutions, the fixing structures and heat dissipating bodies, all together dictate the achievable performance level in the lighting application. The amount of lumens achievable from the application is a function of the heat transfer capacity of the structure.

Figure 8A:
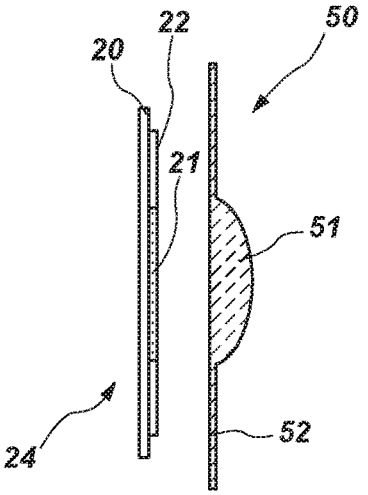
FIG. 8*a* is a cross-sectional side view of a lens and LED assembly in accordance with one aspect of the technology.
Figure 8B:
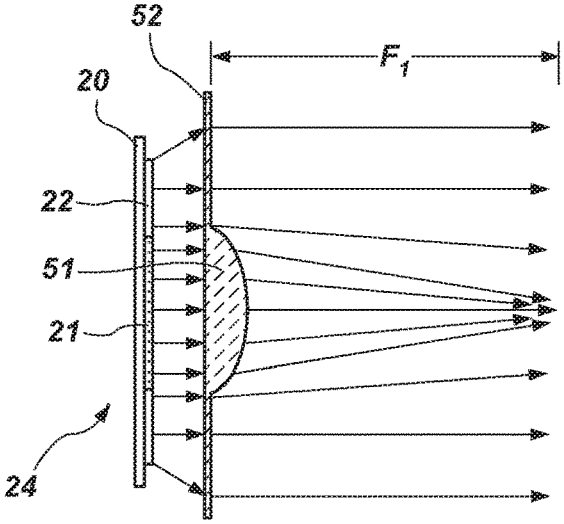
FIG. 8*b* is a cross-sectional side view of a lens and LED assembly in accordance with one aspect of the technology.
Figure 8C:
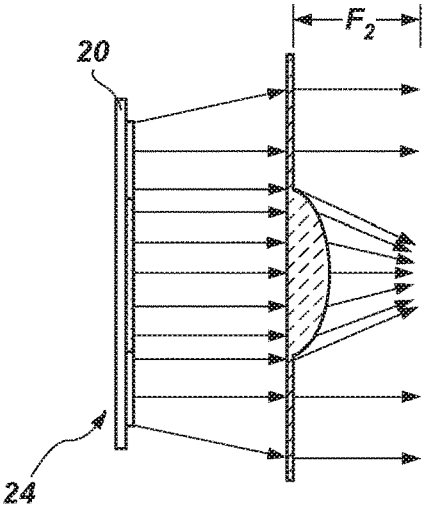
FIG. 8*c* is a cross-sectional side view of a lens and LED assembly in accordance with one aspect of the technology.

In one aspect of the technology, a plurality of LEDs having a similar power rating or intensity, or a single high power LED, is disposed about a single substrate as part of an LED assembly and fixed in a lighting device, such as a flashlight. An axially moveable or adjustable lens is coupled to a distal end of the lighting device in the light path of the LED assembly. In another aspect of the technology, a perceived high-lumen output is achieved by mixing different intensity LEDs on the same substrate or chip forming an LED assembly. For purposes of the present disclosures, and in aspects of the technology, LED intensity is generally categorized by "high-power" LEDs, "mid-power" LEDs, and "low-power" LEDs. While there may be overlap between ranges, generally speaking, a high-power LED comprises a diode having an output ranging from 110 lumens/watt to 150 lumens/watt, a mid-power LED comprises a diode having an output ranging from 80 lumens/watt to 120 lumens/watt, and a lower-power LED comprises a diode having an output ranging from 50 lumens/watt to 100 lumens/watt. With reference generally to FIG. 1 and more specifically to FIGS. 4-8, in one aspect of the technology, a high-power LED sub-assembly (or plurality of sub-assemblies with the same or different densities of LEDs) is placed in the center 21 of a substrate 20 and surrounded by lower powered LEDs (i.e., a low or mid-powered LED sub-assembly) on an outer portion 22 of the substrate 10. The high power LED sub-assembly, the center 21, substrate 20, or outer portion 22 all may or may not include an integrated lens, through direct molded encapsulant, or other bonding technology. A lens 50 is disposed about the front of the substrate 10 having a focusing or convex configuration 51 to focus the light emanating from the high power LEDs. A portion 52 of the lens 51 corresponding with the lower powered LED sub-assembly is flat. The different sub-assemblies can be selectively powered on and off. In an aspect where a high density high-power LED sub-assembly is powered on by itself, the center portion of the lens 50 operates to project a "focused" beam of light or a beam of light that appears to be focused without mechanically changing the distance between the lens 50 and the substrate 20. In a different operational mode, the low-density high-powered sub-assembly is activated along with the lower-powered sub-assembly so that light is propagated from both the inner and outer portion (21, 22) of the LEDs disposed on the substrate 20 providing a broader beam that could be focused through manual manipulation of the lens 50. With reference more specifically to FIGS. 8*a* through 8*c*, in one aspect of the technology, light that is propagated from a center or middle portion 21 of the LED assembly 24 has a first focal length F1 when the lens 50 is disposed a first distance from the LED assembly 24 and a second focal length F2 when the lens 50 is disposed a second distance from the LED assembly 24. As the lens 50 is moved away from the LED assembly 24, light propagated from the convex portion 51 of the lens is focused more than the light propagated through the flat section 52 of the lens 50. In this aspect, the center portion 21 of the LED assembly 24 comprises high-powered LEDs and the outer portion 22 comprises mid or low-powered LEDs. It is understood, however, that the opposite configuration is contemplated herein (i.e., lower-powered LEDs in center portion 21 and high-powered in outer portion 22). Many other lens configurations and configurations of LED assemblies could be used as suits a desired application where different combinations of different powered LEDs are placed on different portions of the substrate.

In one aspect of the technology, different portions of a substrate can have different densities of LED assemblies. Meaning, a first portion may have a first density of LEDs and a second portion may have a second density of LEDs, where the first density is greater than the second density, though in one aspect of the technology the density of the LEDs is substantially consistent across the surface of the substrate. In one aspect, the power rating of the different LEDs may be the same or they may be different. In one aspect, the LEDs are COB LEDs and are placed within the void of an elongate handheld lighting device housing, with the LEDs oriented in a direction to propagate light in the axial direction of the elongate housing. In this aspect, an axially adjustable lens is placed at a distal end of the housing and operates to focus the light propagated from the COB LEDs.

In accordance with one aspect of the technology, an LED assembly comprises a sapphire substrate and includes at least an N type semiconductor layer, a semiconductor light emitting layer and a P type semiconductor layer, which are sequentially stacked. In one aspect, the N type semiconductor layer is an N type GaN (gallium nitride) layer, the semiconductor light emitting layer may consist of gallium nitride or indium gallium nitride, and the P type semiconductor layer is a P type GaN layer. Other substrates are contemplated for use herein, including thin film substrates, and other flexible polymer substrates. The P type semiconductor layer and the N type semiconductor layer are respectively connected to a positive end and a negative end of an external power source by at least one electrical connection line. A thermally conductive binding layer is used to bind the LED chip to the substrate. In general, the thermally conductive binding layer consists of silver paste, tin paste, copper-tin alloy or gold-tin alloy. A circuit layer is formed on the substrate and includes a circuit pattern. Electrical connection lines are used to connect the LED chip to the circuit layer. That is, the positive and negative ends of the LED chip are respectively connected to the positive and negative terminals of the circuit layer so as to supply power to the LED chip and activate the LED light. In one aspect, a fluorescent binder or coating is deposited directly on top of the LED chip to provide the effect of fluorescence. More specifically, the fluorescent binder can convert the original light generated by the LED chip into output light within the spectrum of visible light with a specific wavelength. For example, the original light with the spectrum of ultraviolet may be converted into substantially blue (425 to 450 nm) or substantially red (650 to 700 nm) light, or a mixture of different wavelengths. In one aspect of the technology, there is no fixed lens or cover placed over the binder. Rather, the binder 30 or coating is placed directly on top of the face of the LED such as that shown in FIG. 9.

In aspects of the technology, portions of a single substrate are populated with high-power LEDs while other portions of the substrate are populated with LEDs that are lower powered (i.e., mid-power or low-power) than the high power LEDs forming a lighting assembly. A lens is disposed in front of (forward of the LED light emission pathway) the substrate or lighting assembly, wherein the axial distance between the lens and the lighting assembly is fixed or, in another aspect, is adjustable. In one aspect of the technology, the portion of the lighting assembly that comprises the high-power LEDs has a first fluorescent binder or coating and the portion of the lighting assembly with the lower powered chips has a second fluorescent binder. In one aspect of the technology, the composition of the first binder is different than the composition of the second binder. The combination of light emanating from the two different portions of the assembly through the different binders optimizes the total beam of light from the assembly. In one aspect of the technology, the high-power LEDs with a first binder are rated at between 6000 and 7000 CCT and the lower-powered section is rated at between 3500 and 4500 CCT. In order to differentiate the various hues of white, artificial light sources like LEDs are labeled with a correlated color temperature, or CCT. CCT is measured in degrees Kelvin (K), and this temperature rating indicates what tone of white light will be emitted from the fixture.

In other aspects of the technology, an adjustable lens is shaped to provide different focal lengths to the different portions of the light assembly. For example, portions of the light assembly having the high-powered LEDs may correspond to a portion of the lens configured to provide a focal length that is greater than a portion of the lens corresponding to the portions of the light assembly having mid or low-powered LEDs. Advantageously, the different focal lengths of the single lens corresponding to different portions of the light assembly with different powered LEDs creates a uniform beam of light at an optimized lumen value using less power and creating less heat to be dissipated by the light assembly. In another aspect of the technology, the lens may have a fixed portion and an adjustable portion, each portion corresponds to a different section of the substrate populated with different powered LEDs. In one aspect, a portion of the lens corresponding to the center of the substrate (e.g., center portion 51 shown on lens 50) is adjustable axially with respect to the direction of light propagated from the LEDs, a second portion of the lens (e.g., outer portion 52 on lens 50) corresponding with an outer portion of the substrate is fixed, though the opposite arrangement is also contemplated herein. Meaning, an inner portion may be fixed while the outer portion is moveable. In one aspect of the technology, the adjustable lens is associated with an LED assembly with LEDs having similar power ratings or intensities, the different shaped portions (e.g., lenses shown in FIGS. 4-14) will focus different portions of the light emanating from the LED assembly.

Figure 15:
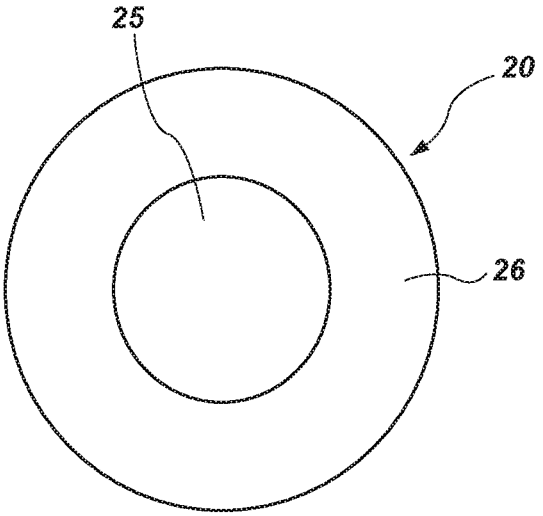
FIG. 15 is a top view of an LED assembly in accordance with one aspect of the technology.
Figure 16:
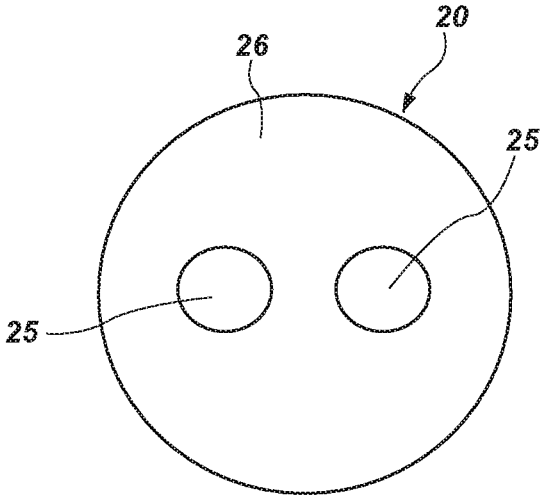
FIG. 16 is a top view of an LED assembly in accordance with one aspect of the technology.
Figure 17:
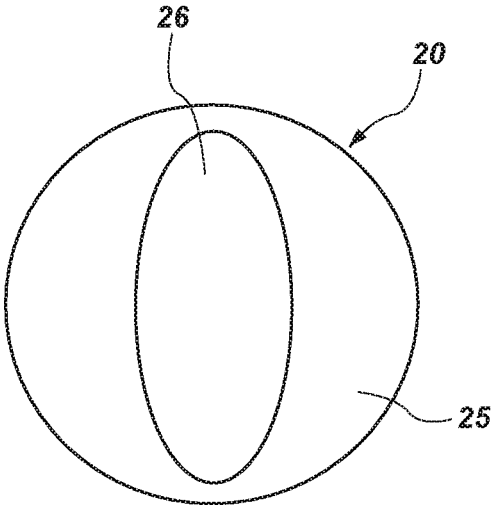
FIG. 17 is a top view of an LED assembly in accordance with one aspect of the technology.
Figure 18A:
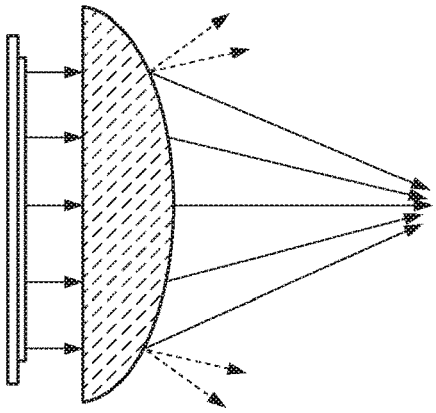
FIG. 18a (Prior Art)
FIG. 18*a* is a cross sectional view of a lens and LED assembly.

In aspects of the technology, the distribution or grouping of different powered LEDs varies as suits a particular design. For example, with reference to FIGS. 1-3 and 15-17 generally, a substrate 20 is populated with a plurality of LEDs rated at a first power output (i.e., intensity) in a first zone 25 and a second plurality of LEDs rated at a second power output in a second zone 26. The first power output is different than the second power output. For example, in accordance with one aspect of the technology, a first zone 25 on the substrate 20 comprises a plurality of LEDs with diodes having an output ranging from 110 lumens/watt to 150 lumens/watt and a second zone 26 comprising a plurality of LEDs with diodes having an output ranging from 80 lumens/watt to 120 lumens/watt. The different zones may be shaped to approximate any pattern of light desired by an end user. For example, FIG. 15 discloses two concentric zones, while FIG. 16 discloses three different zones. The two smaller zones 25 shown on FIG. 16 may have the same rated LEDs while the larger zone 26 comprises LEDs with a different power rating or intensity. However, in another aspect of the technology, all three of the zones shown in FIG. 16 may have different rated LEDs. The different zones may also have different colored LEDs and/or be covered with different binders capable of producing different colors. For example, the two smaller zones 25 may be coated with a first fluorescent binder and the larger zone 26 may be coated with a different fluorescent binder to create different wavelengths of light emanating from the different zones. FIG. 17 illustrates one aspect of the technology where the shape of the different zones is an oval. Other shaped zones are contemplated for use herein as suits a particular design, the end goal being a combination of light zones used in connection with a particular lens to achieve a desired pattern of light.

A conventional LED has a plastic plano-convex dome placed on top of the LED itself to focus or spread the light. Typical spatial distribution (divergence characteristics) of light emitted from an LED is measured in degrees from a center point of the LED. For example, an LED may be rated at 115 degrees in both x and y directions (i.e., the beam will extend 57.5 degrees on either side). The light will be stronger the closer one is to the center. Along the center axis, the LED emits 100% of its relative luminous intensity and will lose intensity farther away from the center. An LED running at 350 mA, for example, rated at 139 lumens at the central axis will drop to 125 lumens at 30 degrees from center. This continues to drop until at 57.5 degrees one is only getting about half the lumen output at 70 lumens. In one aspect of the technology, optics are used to collimate the light rays into a controlled beam that will bring the greater light intensity to a desired area. In aspects of the technology, reflectors are used in connection with an internal lens. With LEDs, the majority of light rays coming from the center of the emitter may pass out of the system without even touching the reflector. This means that even with a narrow reflective system, a significant portion of the light strays wide of the target. This results in lost lumen output or creates an unwanted glare. In one aspect of the technology, an internal adjustable lens is used either alone or in connection with a reflector and is generally injection molded from a polymer and is used a refractive lens, by itself or inside a reflector. In other aspects of the technology, however, a LED assembly is used without a reflector.

Different LEDs have different patterns of light distribution which require collimation in order to be effective, whether used with a reflector or without a reflector. For example, in one aspect of the technology, an LED has a divergence of 38 degrees in x and 47 degrees in y. The focal length is given by the formula f=D/(2*tan(alpha/2)), where D is the desired beam diameter and alpha is the full beam divergence in the direction in question. For this example, for a desired beam diameter of 25 mm:

$$fx=25/(2_\tan(38/2)=36 \text{ mm } fy=25/(2_\tan(47/2)=29 \text{ mm}$$

A different LED may have different divergence characteristics resulting in a different focal length at the same desired beam diameter. A lens configured to optimize the focal lengths of the different LEDs (or LED assemblies) for the same desired beam diameter will advantageously optimize beam lumens while minimizing power consumption and heat production.

Figure 9:
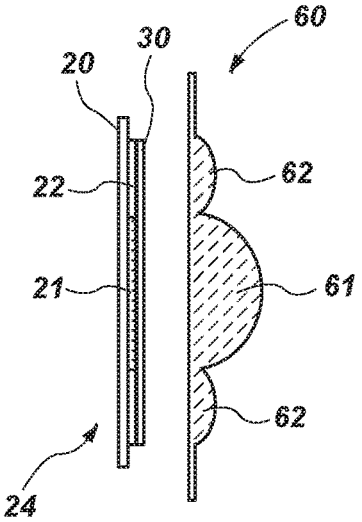
FIG. 9 is a cross-sectional side view of a lens and LED assembly in accordance with one aspect of the technology.
Figure 10:
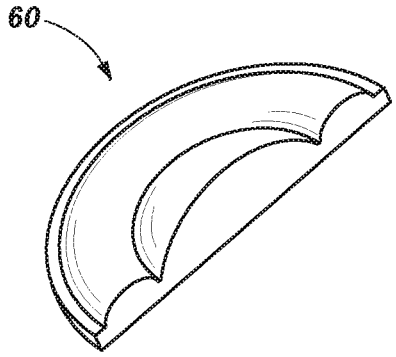
FIG. 10 is a perspective cross-sectional view of a lens in accordance with one aspect of the technology.
Figure 11:
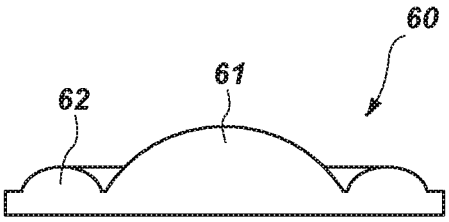
FIG. 11 is a cross-sectional side view of a lens in accordance with one aspect of the technology.
Figure 12:
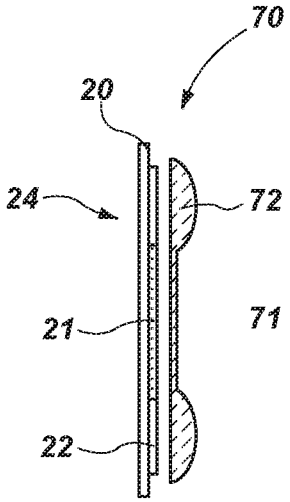
FIG. 12 is a cross-sectional side view of a lens and LED assembly in accordance with one aspect of the technology.
Figure 13:
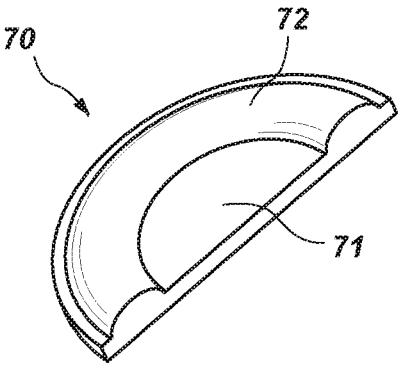
FIG. 13 is a perspective cross-sectional view of a lens in accordance with one aspect of the technology.
Figure 14:
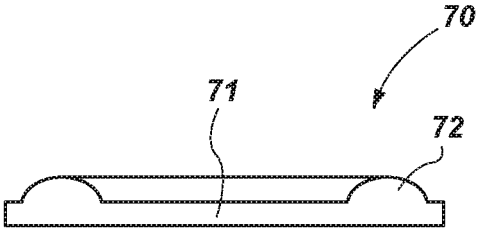
FIG. 14 is a cross-sectional side view of a lens in accordance with one aspect of the technology.

With reference to FIGS. 6-14, in one aspect of the technology, a plurality of cross sectional images of an LED assembly is provided with a corresponding lens. While the LED configuration on the underlying substrate is illustrated as being the same, it is understood that any variety of different LED configurations (e.g., those shown on FIGS. 2, 3, and 15-17) and lenses tailored to optimize the light pattern are contemplated herein. Meaning, any number of different LED configurations can be used with any number of different lens designs to achieve a desired effect so long as the end result is an optimal light pattern, the different LED zones passing through different portions of the lens. For example, FIGS. 9-11 illustrate a circular lens 60 with an outer convex ring 62 and inner convex portion 61. The outer ring 62 corresponds with an outer portion 22 of the LED assembly 24. The inner convex portion 61 corresponds to the inner portion 21 of the LED assembly. FIGS. 12-14 illustrate a circular lens 70 with an inner flat portion 71 corresponding to the inner portion 21 of the LED assembly 24 and an outer ring 72 corresponding to the outer portion 22 of the LED assembly 24. While reference is made herein to convex lenses, it is understood concave lenses or other lens configurations may also be used.

It is also understood that the different LED configurations may be used with a conventional convex lens if that is desired by a person skilled in the art. For example, FIGS. 1-3, in one aspect of the technology illustrate a handheld flashlight 10 with different LED configurations propagated through a conventional convex lens 15, which is coupled to the flashlight 10 by cap 11 in a threaded arrangement. The LED assembly in FIG. 1 comprises a substrate 20 having a plurality of LEDs rated at a first power output (i.e., intensity) in a first zone 21 and a second plurality of LEDs rated at a second power output in a second zone 22. The first power output is different than the second power output. As noted herein, while two zones are referenced, it is understood that the substrate may comprise more than two zones of different-rated (i.e., different intensity) LEDs. Moreover, a single zone may have many different-rated LEDs therein that are separately operable by a power switch. Meaning, zone 21 may have both high and low-power LEDs and zone 22 may have both high and lower-power LEDs. However, each of the different-rated LEDs within each zone are separately operable by a logic control circuit allowing for different light intensities to be propagated through the same or different zones as desired.

With reference to FIGS. 18*a*-18*d*, in one aspect of the technology, in lieu of, or in addition to, a tailored adjustable lens, a substrate 120 upon which LEDs are affixed is shaped to approximate a three dimensional dome forming a multi-axis LED assembly 124. In this manner, a single continuous lens may be used with LEDs having different focal lengths, or with the same focal lengths to achieve a desired effect. For example, because the substrate 120 itself is curved in the x and y directions, the light emanating from the LEDs is distributed in a much broader pattern. In one aspect of the technology, the arced or domed LED assembly 124 propagates light in a broad pattern. While light 140 may be focused from a more center portion 121 of the LED assembly 124, stray light 145 escaping from side portions of lens 130 casts a broad pattern of light. When the user wishes to narrow that pattern, he/she may adjust the distance between the lens 130 and the LED assembly, however, the domed or multi-axis assembly 124 propagates a wider beam than a flat substrate. In one aspect of the technology, the domed or multi-axis substrate is used in connection with a lens 135 having a curved back (i.e., a cancavo-convex lens) corresponding to the axis of the substrate itself like that shown in FIGS. 18*c*-18*d*. Advantageously, this creates a broad pattern of light that may be beneficial for different applications.

Support Components

Figure 19:
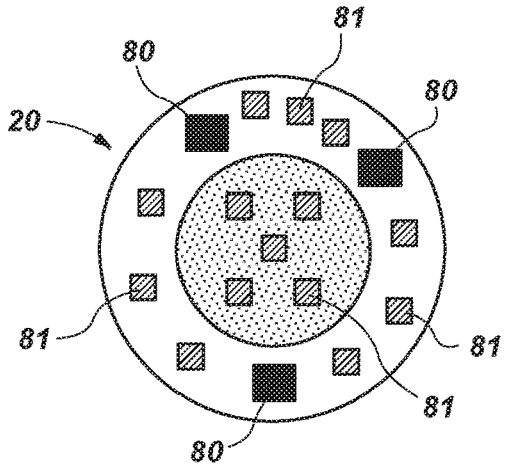
FIG. 19 is a top view of a an LED assembly in accordance with one aspect of the technology.
Figure 18B:
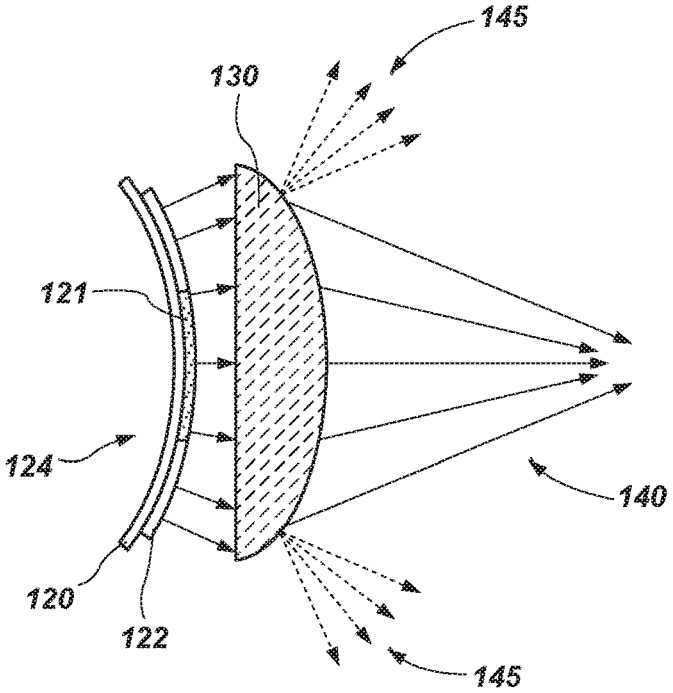
FIG. 18*b* is a cross sectional view of a lens and LED assembly in accordance with one aspect of the technology.
Figure 18C:
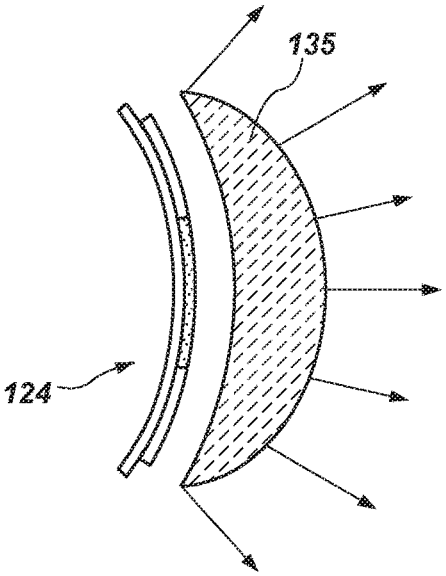
FIG. 18*c* is a cross sectional view of a lens and LED assembly in accordance with one aspect of the technology.
Figure 18D:
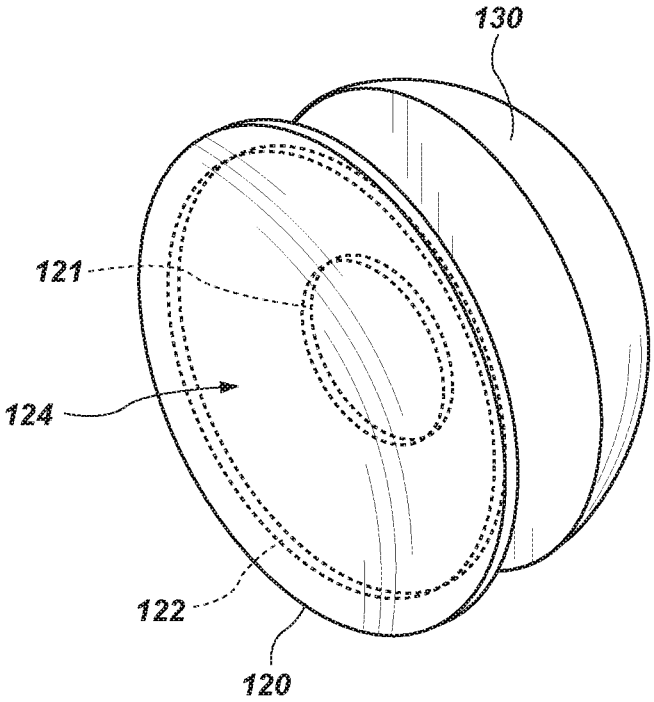
FIG. 18*d* is a perspective back view of FIG. 18*b;*

In another aspect of the technology, the different zones of different LED configurations or different LED intensities allows for placement of different support components 80 on the substrate 20 that would otherwise be required to be placed on the different chip (e.g., power control chip, memory chip, or conventional printed or integrated circuit board. Placing the support components 80 on the substrate 20 amongst the LEDs 81 (see, e.g., FIG. 19), allows the person of ordinary skill to make other chips or circuit components smaller thus taking up less internal space and allowing for the construction of smaller lighting devices. Moreover, components that may generate a substantial amount of heat may be placed on the substrate 20 with the LEDs 81 that are all generally coupled to a heat sink. Those components would otherwise have to be placed on the integrated circuit board that does not dissipate heat as efficiently as the substrate paired with the heat sink. For example, in one aspect of the technology, a PTC thermistor and/or resistive or current control components reside on the substrate 20 instead of on the printed circuit board.

Control Circuits

Figure 20:
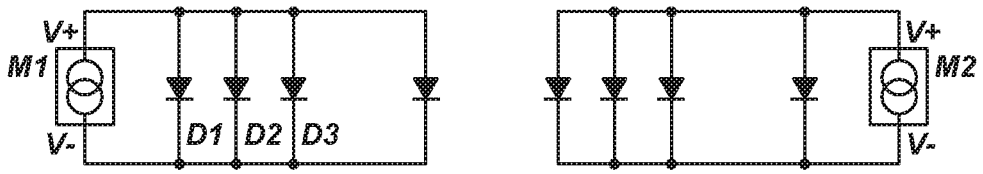
FIG. 20 is an electrical schematic in accordance with one aspect of the technology.
Figure 21:
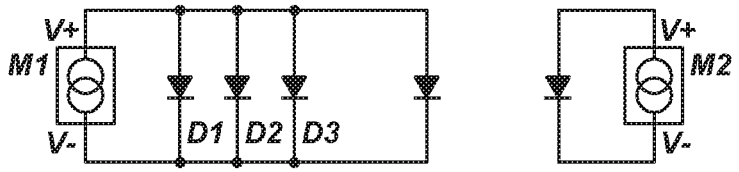
FIG. 21 is an electrical schematic in accordance with one aspect of the technology.
Figure 22:
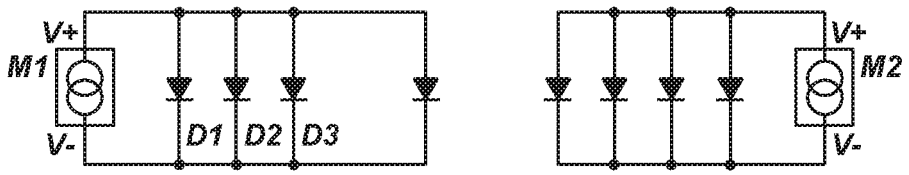
FIG. 22 is an electrical schematic in accordance with one aspect of the technology.

With reference to FIGS. 20-22, in accordance with one aspect of the technology, the different zones of the LED configurations are controllable by a control circuit or printed circuit board. In one aspect of the technology, a single drive circuit may be used. However, in other aspects, multiple drive circuits are employed. M1 represents a current source which drives D1 through Dn, which is an array of paralleled LED chips (total quantity n). M2 represents the current source which drives Dx1 through Dxy, which is a second array (different wavelength/color, or different mechanical configuration) of paralleled LED chips (total quantity y). The current sources may also be a voltage source that are current limited with a series resistor, or via a pulse-width modulated FET. They may also be either common anode or common cathode to simplify the COB substrate layout. LEDs D1 through Dn, and/or Dx1 through Dxy each represent a series of combinations, meaning each of these diodes represents two or more LEDs in series. It is understood that there may also exist a multitude of additional arrays and individual current sources in accordance with different aspects of the technology.

With reference to FIG. 21, M1 represents a current source which drives D1 through Dn, which is an array of paralleled LED chips (total quantity n). M2 represents a current source which drives a pre-packaged or discrete LED Dx, which is placed in the center of the substrate, though it can be placed in other portions of the substrate as desired. Current sources may also be a voltage source that are current limited with a series resistor, or via a pulse-width modulated FET. They may also be either common anode or common cathode to simplify PCB layout. As with FIG. 20, LEDs D1 through Dn may each represent a series of combinations, meaning each of these diodes may represent two or more LEDs in series. FIG. 22 adds additional discrete LEDs to the configuration disclosed in FIG. 7 to the current source M2 (LEDs Dx1 through Dx4).

In accordance with one aspect of the technology, a method of propagating light from a portable lighting device is disclosed comprising providing power to an LED assembly, the LED assembly comprising a substrate and a plurality of LEDs disposed thereon. In one aspect of the technology, the plurality of LEDs comprises a first plurality of LEDs having a first power rating and a second plurality of LEDs having a second power rating and wherein a fluorescent binder is disposed about a top face of the first and second plurality of LEDs. The first plurality of LEDs propagates light from through a first portion of a lens disposed coaxially with the LED assembly to form a first beam of light having a first pattern. The second plurality of LEDs propagates light through a second portion of the lens to form a second beam of light having a second pattern. In one aspect of the technology, the first portion of the lens has a first focal length and the second portion of the lens has a second focal length, the first focal length being different than the second focal length. The method further comprises adjusting the distance between the lens and the LED assembly to adjust the pattern of the first beam of light and the second beam of light.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein. Moreover, while different aspects of the technology or described individually, it is understood that different parts of the different aspects may be combined in any number of different configurations.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus-function are expressly recited in the description herein. Accordingly, the scope of the invention should be determined solely by the appended claims and their legal equivalents, rather than by the descriptions and examples given above.

The invention claimed is:

1. A portable lighting apparatus, comprising:

an LED assembly comprising a substrate and a plurality of co-planar LEDs disposed thereon, wherein the plurality of LEDs comprises a first plurality of LEDs having a first power rating and a second plurality of LEDs having a second power rating;

a power source coupled to the LED assembly and a control module, the control module configured to selectively power the first plurality of LEDs and the second plurality of LEDs;

a lens disposed about the LED assembly, said lens having a first portion corresponding to the first plurality of LEDs and a second portion corresponding to the second plurality of LEDs, wherein the geometry of the first portion of the lens is different than the geometry of the second portion of the lens.

2. The portable lighting apparatus of claim 1, wherein the first plurality of LEDs have a power rating ranging from 110 lumens/watt to 150 lumens/watt and the second plurality of LEDs have a power rating ranging from 80 lumens/watt to 120 lumens/watt or 50 lumens/watt to 100 lumens/watt.

3. The portable lighting apparatus of claim 1, wherein the geometry of the first portions of the lens comprises a plano-convex geometry and the second portion of the lens comprises a planar geometry.

4. The portable lighting apparatus of claim 3, wherein the first portion of the lens has a focal length that is different than a focal length of a second portion of the lens.

5. The portable lighting apparatus of claim 1, wherein the first plurality of LEDs are disposed within a first area that is at least partially enclosed by a second area, wherein the second plurality of LEDs are disposed within the second area.

6. The portable lighting apparatus of claim 5, wherein the first plurality of LEDs are disposed about the substrate forming a first LED subassembly and the second plurality of LEDs are disposed about the substrate forming a second LED subassembly.

7. The portable lighting apparatus of claim 6, wherein the substrate further comprises a support component disposed about a face of the substrate adjacent the first plurality of LEDs or the second plurality of LEDs, wherein the support component comprises a temperature sensor, a current controller, or a resistance controller.

8. A portable lighting apparatus, comprising:

a housing;

an LED assembly having a center disposed about the housing, said assembly comprising a first plurality of LEDs disposed about a fixed substrate having a first power rating and a second plurality of LEDs having a second power rating disposed about the fixed substrate, wherein each of the first power rating is different than the second power rating and wherein each of the first plurality of LEDs and each of the second plurality of LEDs have a top face;

a fluorescent binder disposed about the top face of each of the first plurality of LEDs and second plurality of LEDs;

a lens disposed about the housing, a center of the lens located coaxial with a center of the LED assembly; and a power source disposed within the housing, said power source coupled to the LED assembly and a control module located within the housing, the control module configured to selectively power the first plurality of LEDs and the second plurality of LEDs to propagate light through the lens.

9. The portable lighting apparatus of claim 8, wherein the fixed substrate approximates the shape of a dome and is curvilinear in a first direction and a second direction, the first direction being normal to the second direction.

10. The portable lighting apparatus of claim 9, wherein the lens is plano-convex or concavo-convex.

11. The portable lighting apparatus of claim 8, wherein the lens has a first portion corresponding to the first plurality of LEDs and a second portion corresponding to the second plurality of LEDs, the first portion of LEDs having a first fluorescent binder, the second portion of LEDs having a second fluorescent binder.

12. The portable lighting apparatus of claim 11, wherein the first portion of the lens has a first focal length and the second portion of the lens has a second focal length, the first focal length being different than the second focal length.

13. The portable lighting apparatus of claim 8, wherein the distance between the lens and the LED assembly is adjustable.

14. A method of propagating light from a portable lighting device, comprising:

providing power to an LED assembly, said LED assembly comprising a fixed planar substrate and a plurality of coplanar LEDs disposed thereon, wherein the plurality of LEDs comprises a first plurality of LEDs having a first power rating and a second plurality of LEDs having a second power rating and wherein a fluorescent binder is disposed about a top face of the first and second plurality of LEDs;

propagating light from the first plurality of LEDs through a first portion of a lens disposed coaxially with the LED assembly to form a first beam of light having a first pattern; and propagating light from the second plurality of LEDs through a second portion of the lens to form a second beam of light having a second pattern.

15. The method of claim 14, wherein the first portion of the lens has a first focal length and the second portion of the lens has a second focal length, the first focal length being different than the second focal length.

16. The method of claim 15, further comprising the step of providing power to the first plurality of LEDs and the second plurality of LEDs simultaneously.

17. The method of claim 15, further comprising adjusting the distance between the lens and the LED assembly to adjust the pattern of the first beam of light and the second beam of light.

18. A portable lighting apparatus, comprising:

an elongate housing having a distal end, a proximal end, and an axial direction;

a chip-on-board LED assembly comprising a fixed planar substrate and a plurality of coplanar LEDs, the chip-on-board LED assembly being disposed in a void within the housing and being configured to propagate a beam of light in a direction parallel with the axial direction of the housing;

a power source disposed within the housing, the power source coupled to the LED assembly and a control module, the control module configured to provide power to the LEDs; and a lens disposed about a distal end of the elongate housing, the lens disposed in an axially adjustable position with respect to the LED assembly.

19. The portable lighting apparatus of claim 18, wherein the LED assembly comprises a plurality of coplanar LEDs disposed on the fixed planar substrate, wherein the plurality of LEDs comprises a first plurality of LEDs having a first power rating and a second plurality of LEDs having a second power rating, the first power rating being different than the second power rating.

20. The portable lighting apparatus of claim 19, wherein the first plurality of LEDs are disposed in an area corresponding to a first non-planar portion of the lens and the second plurality of LEDs are disposed in an area corresponding to a second planar portion of the lens.

21. The portable lighting apparatus of claim 19, wherein the first plurality of LEDs correspond with a first portion of the lens and the second plurality of LEDs correspond with a second portion of the lens, the first portion of the lens having a different focal length than the second portion of the lens.

* * * * *